US011362456B2

(12) United States Patent
Liu et al.

(10) Patent No.: US 11,362,456 B2
(45) Date of Patent: Jun. 14, 2022

(54) WIRING ARRANGEMENT AT WALL EDGES AND CORNERS WITH DECORATIVE EFFECT

(71) Applicant: Guangzhou Xiongyi Precision Metalworking Co., Ltd., Guangdong Proviince (CN)

(72) Inventors: Yong Liu, Guangdong Province (CN); Fangming Cao, Guangdong Province (CN); Robert Lee, Guangdong Province (CN)

( * ) Notice: Subject to any disclaimer, the term of this patent is extended or adjusted under 35 U.S.C. 154(b) by 182 days.

(21) Appl. No.: 16/916,139

(22) Filed: Jun. 30, 2020

(65) Prior Publication Data

US 2021/0408718 A1 Dec. 30, 2021

(51) Int. Cl.

| | |
|---|---|
| ***H01R 9/05*** | (2006.01) |
| ***H01R 13/50*** | (2006.01) |
| ***H01R 13/193*** | (2006.01) |
| ***H01B 7/00*** | (2006.01) |
| *H01R 13/03* | (2006.01) |
| *H01R 13/02* | (2006.01) |

(52) U.S. Cl.
CPC ..... *H01R 13/50* (2013.01); *H01B 7/0045* (2013.01); *H01R 13/193* (2013.01); *H01R 13/025* (2013.01); *H01R 13/03* (2013.01)

(58) Field of Classification Search
CPC ..... H01R 2103/00; H01R 9/0521; H01R 13/65802; H01R 13/514; H01R 9/2408; H01R 9/16; H01R 31/00; H01R 31/02; H01R 13/65805
See application file for complete search history.

(56) References Cited

U.S. PATENT DOCUMENTS

| | | | | |
|---|---|---|---|---|
| 6,491,545 | B1 * | 12/2002 | Spiegel | H01R 13/6586 439/931 |
| 8,013,249 | B2 * | 9/2011 | Watanabe | H01B 7/426 174/75 C |
| 8,366,485 | B2 * | 2/2013 | Johnescu | H01R 13/514 439/607.09 |
| 2004/0094328 | A1 * | 5/2004 | Fjelstad | H01R 12/714 174/251 |

* cited by examiner

*Primary Examiner* — Phuong Chi Thi Nguyen

(74) *Attorney, Agent, or Firm* — Prakash Nama; Global IP Services, PLLC

(57) ABSTRACT

Wiring arrangement at wall edges and corners with decorative effect, having at least two elongated wire guiding strips; each wire guiding strip is positioned at a wall edge between a wall and a floor or a wall edge between two adjacent walls; each wall edge between the wall and the floor or each wall edge between two adjacent walls is provided with only one of the wire guiding strips; a corner connector is provided between two ends of two adjacent wire guiding strips to achieve electrical connection and a change in direction of the wiring arrangement; the corner connector has two legs electrically connected to two ends of the two adjacent wire guiding strips respectively; each of the wire guiding strips has a soft PVC wrapping layer and wires wrapped inside. The wiring arrangement has a reasonable structure and is safe and aesthetically pleasing.

9 Claims, 3 Drawing Sheets

WIRING ARRANGEMENT AT WALL EDGES AND CORNERS WITH DECORATIVE EFFECT

BACKGROUND OF THE INVENTION

The present invention relates to the field of indoor electrical connection, and more specifically relates to wiring arrangement at wall edges and corners with decorative effect.

Due to safety and aesthetical reason, indoor circuit arrangement in the field of interior decoration will arrange the wires inside wire grooves, and the wire grooves will be embedded into wall edges and corners or will be buried underground in advance. Nowadays, wiring arrangement in most interior decoration arranges the wires inside the wire grooves. However, the wires are arranged in bad order and tangled in a complicated manner inside the wire grooves. When it is required to replace the wires inside the wire grooves, the wire grooves have to be revealed by digging up the wall edges or corners or the floors before the wires can be replaced. As such, replacement of the wires is complicated, and the interior decoration will be damaged. Also, aging wires inside the wire grooves that can be easily resulted after a long period of use may cause the conductive cores of the wires to expose which can easily lead to short circuit that in serious cases can threaten the lives and properties of the house owners.

BRIEF SUMMARY OF THE INVENTION

In view of the aforesaid disadvantages now present in the prior art, the present invention provides a kind of wiring arrangement at wall edges and corners with decorative effect, which comprises a reasonable structure and is also safe and aesthetically pleasing.

The above objects of the present invention are fulfilled by means of the following technical solutions: the wiring arrangement comprises at least two elongated wire guiding strips; each of the wire guiding strips is positioned at a wall edge between a wall and a floor or a wall edge between two adjacent walls; each wall edge between the wall and the floor or each wall edge between two adjacent walls is provided with only one of said wire guiding strips; a corner connector is provided between two ends of two adjacent wire guiding strips to achieve electrical connection and a change in direction of the wiring arrangement; the corner connector comprises two legs electrically connected to two ends of the two adjacent wire guiding strips respectively; each of the wire guiding strips comprises a soft polyvinyl chloride (PVC) wrapping layer and wires wrapped within the wrapping layer.

Preferably, said two ends of the two adjacent wire guiding strips are each provided with an exposed portion of the wires; the corner connector is provided with copper sleeves communicating the two legs and allowing insertion of the wires of the exposed portion of each wire guiding strip to achieve electrical connection.

Preferably, the wires of each of the wire guiding strips comprise a ground wire, a neutral wire and a live wire; the ground wire, the neutral wire and the live wire are wrapped within the wrapping layer in a way that the ground wire, the neutral wire and the live wire are mutually separated and insulated from one another within the wrapping layer; the exposed portion of the wires of each wire guiding strip comprises a neutral wire exposed end, a live wire exposed end and a ground wire exposed end; correspondingly, the corner connector is provided with three copper sleeves; the three copper sleeves are provided in the corner connector in a way that the three copper sleeves are mutually separated and insulated from one another.

Preferably, the corner connector is made of insulation material; the corner connector and the three copper sleeves are manufactured integrally by injection molding.

Preferably, in each of the legs, a locking hole is provided corresponding to each copper sleeve; an opening is provided on a wall of each copper sleeve corresponding to the respective locking hole; each opening is in communication with an interior of the corresponding copper sleeve; a locking screw is provided corresponding to each locking hole; each locking screw is inserted into the corresponding locking hole and the corresponding opening and thus into the corresponding copper sleeve, so as to fix a corresponding exposed end of a corresponding wire inserted into the corresponding copper sleeve.

Preferably, the soft PVC wrapping layer and the wires wrapping within the wrapping layer of each wire guiding strip are manufactured integrally by co-extrusion.

Preferably, the exposed end of each wire is hardened by copper coating at an end thereof or being tin cladded.

Preferably, each of the wire guiding strips has two side flat surfaces and a curved surface; first edges of the two side flat surfaces are mutually connected so that the two side flat surfaces form an included angle, and second edges of the two side flat surfaces opposite to said first edges are connected via the curved surface; adhesive is applied to a wall or floor facing surface of each of the two side flat surfaces.

Preferably, the included angle between the two side flat surfaces is 90 degrees; the curved surface is an arc or a corrugated surface.

DETAILED DESCRIPTION OF THE INVENTION

Figure 1:
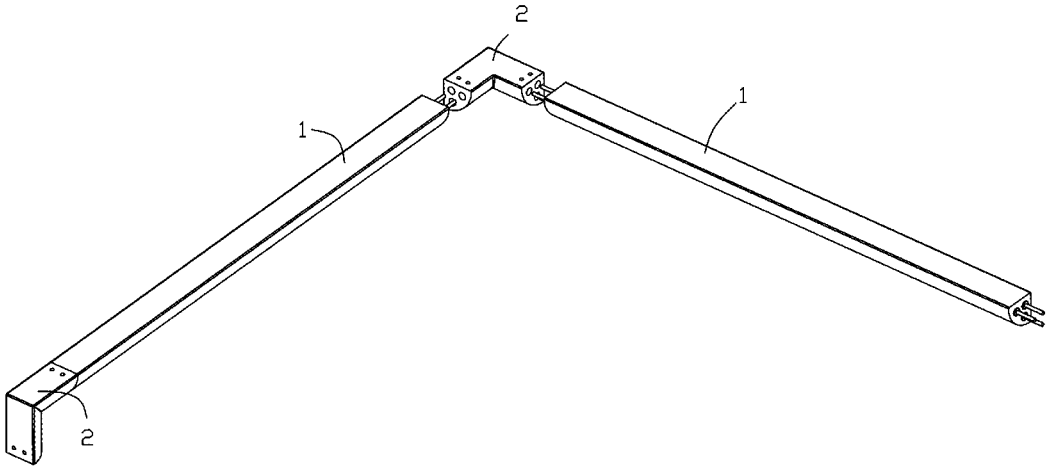
FIG. 1 is a schematic structural view of the wiring arrangement at wall edges and corners with decorative effect according to the present invention.
Figure 2:
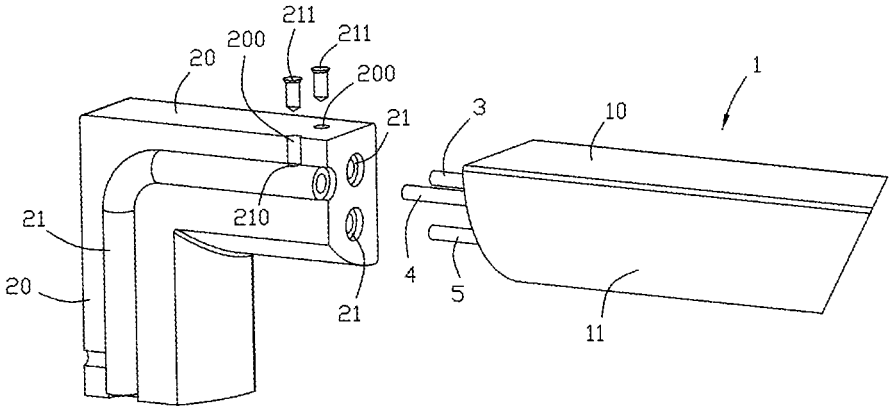
FIG. 2 is a schematic structural view of FIG. 1 showing the corner connector partially sectioned, and the exposed ends of the wires at an end of a wire guiding strip ready but not yet inserted into a corresponding leg of the corner connector.
Figure 3:
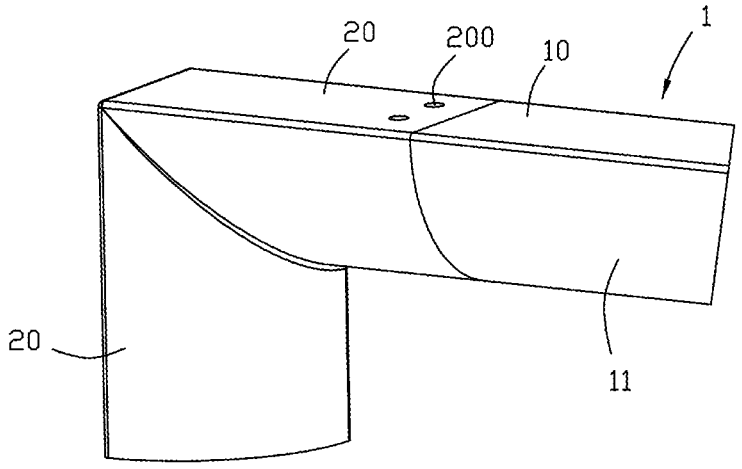
FIG. 3 is a schematic structural view of FIG. 1 where the exposed ends of the wires at the end of a wire guiding strip are inserted into the corresponding leg of the corner connector.
Figure 4:
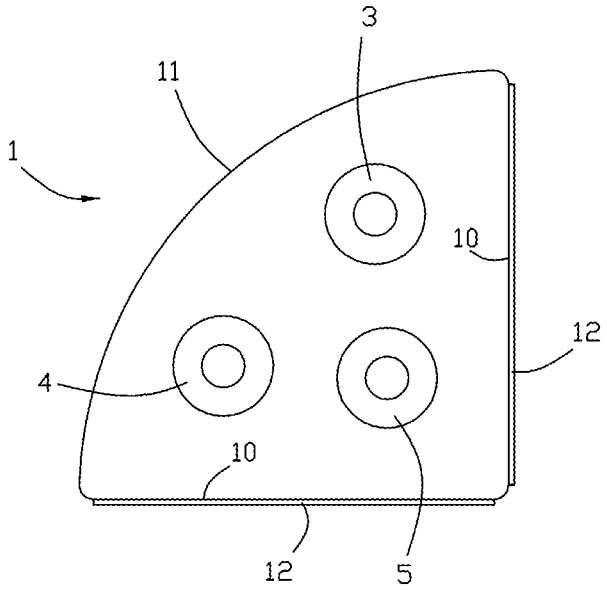
FIG. 4 is a side view of a wire guiding strip of FIG. 1.
Figure 5:
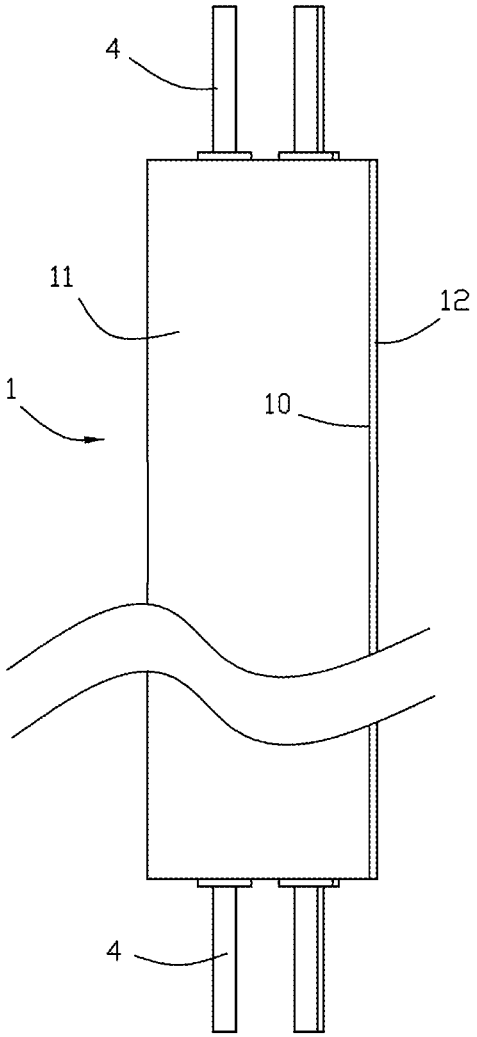
FIG. 5 is a top plan view of a wire guiding strip of FIG. 1.

As shown in FIGS. 1-5, the wiring arrangement of the present invention comprises two elongated wire guiding strips 1. Each of the wire guiding strips 1 may be positioned at a wall edge between a wall and a floor or a wall edge between two adjacent walls, depending on practical need for wire arrangement. Each wall edge between the wall and the floor or each wall edge between two adjacent walls is provided with only one of said wire guiding strips 1. During use, a single preformed wire guiding strip can be cut to form the two wire guiding strips 1. Each of the wire guiding strips 1 comprises two side flat surfaces and a curved surface 11; first edges of the two side flat surfaces are mutually connected so that the two side flat surfaces form an included angle, and second edges of the two side flat surfaces opposite to said first edges are connected via the curved surface 11. In the present embodiment, the included angle between the two side flat surfaces is 90 degrees. Adhesive 12 is applied to a wall or floor facing surface of each of the two side flat surfaces. During use, if a wire guiding strip 1 is positioned at a wall edge between a wall and a floor, one of the side flat surfaces of the wire guiding strip 1 is adhered to the floor via the adhesive 12; if the wire guiding strip 1 is positioned at a wall edge between two adjacent walls, the wall facing surfaces of the two side flat surfaces of the wire guiding strip 1 are adhered to the two adjacent walls respectively via the adhesive 12. Accordingly, mounting, replacement, and dismounting are very convenient. Since the two side flat surfaces are also connected via the curved surface 11, and the curved surface 11 is actually the visible component of the corresponding wire guiding strip when the corresponding wire guiding strip is mounted at a wall edge, so the curved surface can have a good decorative effect and being aesthetically pleasing. The curved surface 11 is preferably configured as an arc or a corrugated surface. In the present embodiment, the curved surface is configured as an arc.

If wire arrangement is required along multiple wall edges constituted by for example multiple wall edges of multiple sets of adjacent wall and floor, or multiple wall edges comprising the wall edge between adjacent wall and floor and the wall edge between two adjacent walls, the wiring arrangement may involve direction changes. In the present embodiment, a corner connector 2 is provided between two ends of two adjacent wire guiding strips 1 to achieve a change in direction of the wiring arrangement. The corner connector 2 comprises two legs 20 electrically connected to the two ends of the two adjacent wire guiding strips 1 respectively. Said two ends of the two adjacent wire guiding strips 1 electrically connected to the corner connector 2 are each provided with exposed portion of wires. The corner connector 2 is provided with copper sleeves 21 communicating the two legs 20 and allowing insertion of the wires from each exposed portion to achieve electrical connection. As shown, the present invention has a very simple structure.

In the present embodiment, each of the wire guiding strips 1 comprises a soft polyvinyl chloride (PVC) wrapping layer and wires wrapped within the wrapping layer. The wires of each of the wire guiding strips 1 comprise a ground wire, a neutral wire and a live wire. The ground wire, the neutral wire and the live wire are wrapped within the wrapping layer in a way that they are mutually separated and insulated from each other within the wrapping layer. The soft PVC wrapping layer and the wires wrapping within the wrapping layer of each wire guiding strip 1 are manufactured integrally by co-extrusion technique. The above described structures prevent the problem of short circuit which is likely to be resulted from exposed conductive cores of the wires as in the prior art.

In the present embodiment, the exposed portion of wires of each wire guiding strip comprises a neutral wire exposed end 3, a live wire exposed end 4 and a ground wire exposed end 5. Correspondingly, the corner connector 2 is provided with three copper sleeves 21. The three copper sleeves 21 are provided in the corner connector 2 in a way that they are mutually separated and insulated from one another. The corner connector 2 is made of insulation material. The corner connector 2 and the three copper sleeves 21 are manufactured integrally by injection molding.

In the present embodiment, in each of the legs 20, a locking hole 200 is provided corresponding to each copper sleeve 21. An opening 210 is provided on a wall of each copper sleeve 21 corresponding to the respective locking hole 200; each opening 210 is in communication with an interior of the corresponding copper sleeve 21. A locking screw 211 is provided corresponding to each locking hole 200. Each locking screw 211 is inserted into the corresponding locking hole 200 and the corresponding opening 210 and thus into the corresponding copper sleeve 21, so as to fix a corresponding exposed end 3/4/5 of a corresponding wire inserted into the corresponding copper sleeve 21. The locking screw 211 functions to press a corresponding exposed end 3/4/5 of a wire tightly within the corresponding copper sleeve 21. The locking screw 211 is made of insulated material, and can be in any form according to prior art. In the present embodiment, the exposed end of each wire is hardened by copper coating at an end thereof or being tin cladded. The above described structures facilitate electrical connection with the corresponding copper sleeve.

The above description only describes the preferred embodiment of the present invention, and should not limit the present invention. Any changes, modifications and alternative configurations with equivalent technical effects made within the spirits and principles of the present invention should fall within the scope of protection of the present invention.

What is claimed is:

1. A wiring arrangement, comprising at least two elongated wire guiding strips; each of the wire guiding strips is adapted to be positioned at a wall edge between a wall and a floor or a wall edge between two adjacent walls; each wall edge between the wall and the floor or each wall edge between two adjacent walls is provided with only one of said wire guiding strips; a corner connector is provided between two ends of two adjacent wire guiding strips to achieve electrical connection and a change in direction of the wiring arrangement; the corner connector comprises two legs electrically connected to two ends of the two adjacent wire guiding strips respectively; each of the wire guiding strips comprises a soft polyvinyl chloride (PVC) wrapping layer and wires wrapped within the wrapping layer.

2. The wiring arrangement of claim 1, wherein the soft PVC wrapping layer and the wires wrapping within the wrapping layer of each wire guiding strip are manufactured integrally by co-extrusion.

3. The wiring arrangement of claim 1, wherein each of the wire guiding strips has two side flat surfaces and a curved surface; first edges of the two side flat surfaces are mutually connected so that the two side flat surfaces form an included angle, and second edges of the two side flat surfaces opposite to said first edges are connected via the curved surface; adhesive is applied to a wall or floor facing surface of each of the two side flat surfaces.

4. The wiring arrangement of claim 3, wherein the included angle between the two side flat surfaces is 90 degrees; the curved surface is an arc or a corrugated surface.

5. The wiring arrangement of claim 1, wherein said two ends of the two adjacent wire guiding strips are each provided with an exposed portion of the wires; the corner connector is provided with copper sleeves communicating the two legs and allowing insertion of the wires of the exposed portion of each wire guiding strip to achieve electrical connection.

6. The wiring arrangement of claim 5, wherein the exposed portion of each wire is hardened by copper coating at an end thereof or being tin cladded.

7. The wiring arrangement of claim 5, wherein the wires of each of the wire guiding strips comprise a ground wire, a neutral wire and a live wire; the ground wire, the neutral wire and the live wire are wrapped within the wrapping layer in a way that the ground wire, the neutral wire and the live wire are mutually separated and insulated from one another within the wrapping layer; the exposed portion of the wires of each wire guiding strip comprises a neutral wire exposed end, a live wire exposed end and a ground wire exposed end; correspondingly, the corner connector is provided with three copper sleeves; the three copper sleeves are provided in the corner connector in a way that the three copper sleeves are mutually separated and insulated from one another.

8. The wiring arrangement of claim 7, wherein the corner connector is made of insulation material; the corner connector and the three copper sleeves are manufactured integrally by injection molding.

9. The wiring arrangement of claim 7, wherein in each of the legs, a locking hole is provided corresponding to each copper sleeve; an opening is provided on a wall of each copper sleeve corresponding to the respective locking hole; each opening is in communication with an interior of the corresponding copper sleeve; a locking screw is provided corresponding to each locking hole; each locking screw is inserted into the corresponding locking hole and the corresponding opening and thus into the corresponding copper sleeve, so as to fix a corresponding exposed end of a corresponding wire inserted into the corresponding copper sleeve.

* * * * *